United States Patent [19]

French

[11] Patent Number: 4,986,784

[45] Date of Patent: Jan. 22, 1991

[54] WATER SPORT DEVICE AND ASSOCIATED SAFETY ANCHORING SYSTEM

[76] Inventor: Phillip B. French, 7805 Mears Rd., Auburn, Calif. 95603

[21] Appl. No.: 379,607

[22] Filed: Jul. 12, 1989

[51] Int. Cl.[5] ..... A63C 15/00

[52] U.S. Cl. ..... 441/65; 114/253; 272/1 B; 272/17

[58] Field of Search ..... 272/1 B, 17, 32, 97, 272/71, 72; 441/65, 74, 75, 79; 114/253

[56] References Cited

U.S. PATENT DOCUMENTS

| | | | |
|---|---|---|---|
| 1,615,568 | 1/1927 | Carrol | 440/34 |
| 2,815,951 | 12/1957 | Baldanza | 272/17 |
| 3,027,574 | 4/1962 | Meehan | 114/253 |
| 3,123,844 | 3/1964 | Bailey | 441/72 |
| 3,352,275 | 11/1967 | Wilson | 441/65 |
| 3,598,402 | 8/1971 | Frenzl | 272/17 |
| 3,807,342 | 4/1974 | Turner | 114/253 |
| 4,302,858 | 12/1981 | Casciano | 441/65 |
| 4,427,394 | 1/1984 | Felter | 114/253 |
| 4,524,711 | 6/1985 | Ashrow | 114/215 |

*Primary Examiner*—Sherman Basinger
*Assistant Examiner*—Thomas J. Brahan
*Attorney, Agent, or Firm*—James M. Ritchey

[57] ABSTRACT

A water sport device for use on flowing water is disclosed comprising a water skimming device attached to one end of a flexible safety rod that is adapted for buoyancy. Connected to the opposite end of the flexible safety rod is one end of a tether having a compacting means to help prevent a rider of the device from becoming entangled in a tether that is not drawn taut. A resilient member adapted for propelling the water skimming device and rider against the flowing water is secured between the other end of the tether and an object serving as an anchor.

19 Claims, 1 Drawing Sheet

WATER SPORT DEVICE AND ASSOCIATED SAFETY ANCHORING SYSTEM

BACKGROUND OF THE INVENTION

1. Field of the Invention

A water sport device is disclosed that allows a user to ride and maneuver on the surface of moving water. In particular, the subject invention is a river current riding device and associated safety anchoring system comprising a water skimming device or riverboard connected to one end of a flexible safety rod that is adapted to be buoyant in water. Connected to the other end of the flexible safety rod is one end of a securing tether having an optional compacting means for gathering the bulk of the tether into a central location when the riverboard is not being forced downstream by a current. Fastened to the other end of the tether is one end of a resilient member. The other end of the resilient member is adapted for fastening to an object that serves as an anchor. The current forces the anchored water skimming device or riverboard downstream while the resilient member allows the rider to maneuver on the surface of the flowing water or river in side-to-side and upstream manners. The buoyant flexible safety rod and the tether compacting means serve as safety elements to help prevent the rider from becoming entangled in the tether.

2. Description of the Background Art

Several water ride related devices exist in the prior art. U.S. Pat. No. 1,772,526 discloses an amusement device for bathing pools. A pulley system, drive mechanism, and associated towing ropes aid the user in movement through a pool.

A device similar to the one above, in '526, is described in U.S. Pat. No. 3,181,861. A towing system for surfboards is related in which a drive mechanism is anchored near a beach and connected by an endless cable to a secondary pulley submerged off-shore. A plurality of tow ropes and floats are attached to the circulating cable to pull a rider through the water.

A water sport riding device is illustrated in U.S. Pat. No. 3,024,944. A tow rope is secured to the device by a three point attachment system. The device is a water ski with a seat mounted on its upper surface. Additionally, the ski has a "rooster tail" generating device incorporated into the rear portion of the ski.

Like '944 above, the device disclosed in U.S. Pat. No. 3,064,286 is a water vehicle comprising a ski and a seat. However, in place of the "rooster tail" generating device of '944, a stabilizing fin has been added to the underside rear of the ski. Further, a one point attachment system is employed to replace the three point version in '944.

A combination water ski and surfboard is described in U.S. Pat. No. 3,216,031. An improved one point attachment system is incorporated into a device that positions a surfboard above a water ski, thereby eliminating the need for one ski on each foot.

U.S. Pat. No. 3,380,425 relates an improved towing line attachment means for a surfboard. The attachment position is beneath and inset from the leading edge of the surfboard. This location allows the rider to position easily the board at the correct angle for a ride. Inexperienced riders are aided by the correct angle of the board.

Described in U.S. Pat. No. 3,802,374 is a surfboard safety towing device. A male/female piston mechanism serving as a towing line attachment joint is incorporated into the bottom surface of a surfboard. A resilient O-ring secures the mating of the piston mechanism during normal towing. However, should the surfboard tip, the joint is designed to release quickly by allowing air to enter a venting hole in the piston.

An amusement device for ocean use disclosed in U.S. Pat. No. 1,615,568 comprises a member carried by a rider of a surfboard and an expansible member interposed between and connected to the member carried by the rider and a stationary object. The device is employed by having the rider pull the carried member away from the stationary object and then initiating a release of the expansible member, thereby causing the rider to be drawn toward the stationary object. It is noted that the tension created in the expansible member is generated primarily by the rider's efforts in towing the carried member a distance away from the stationary object.

SUMMARY OF THE INVENTION

An object of the present invention is to produce a water sport device that safely permits the user to maneuver about and skim on the surface of flowing water.

A further object of the present invention is to construct a safety anchoring system for securing a water skimming device or riverboard to a fixed anchor, whereby when a user intentionally of unintentionally releases the water skimming device or riverboard the anchor connecting tether stays at a safe distance and optionally compacts to prevent entanglement and possible injury to the rider.

An additional object of the present invention is to supply a safety attachment means for securing a riverboard or similar device to a fixed anchor, whereby a flexible safety rod serves as a spacer to isolate the riverboard and rider from an attachment tether, thereby aiding in preventing the rider from becoming entangled in the tether.

As an entertainment sporting device for use upon flowing waters, the subject invention comprises a water skimming device or riverboard connected to a flexible safety rod. The flexible safety rod has two ends, one of which is connected to the riverboard and the other end attached to or continuous with a securing tether. Connected to the other end of the tether is a resilient member, having two ends, that provides a means for propelling the riverboard and rider upstream against the flowing water. This resilient member is fastened from its second end to an anchor, usually on shore, but a moving boat is contemplated as acceptable. To aid in floating the riverboard and the related flexible safety rod, tether, and resilient member, a flotation means is associated with the flexible safety rod. For an optional safety feature, the tether is equipped with a means for reversibly compacting at least a portion of the tether. By compacting the tether, the rider is able to avoid entanglement with a non-stretched tether.

Other objects, advantages, and novel features of the present invention will become apparent from the detailed description that follows, when considered in conjunction with the associated drawings.

DESCRIPTION OF THE PREFERRED EMBODIMENT

Figure 1:
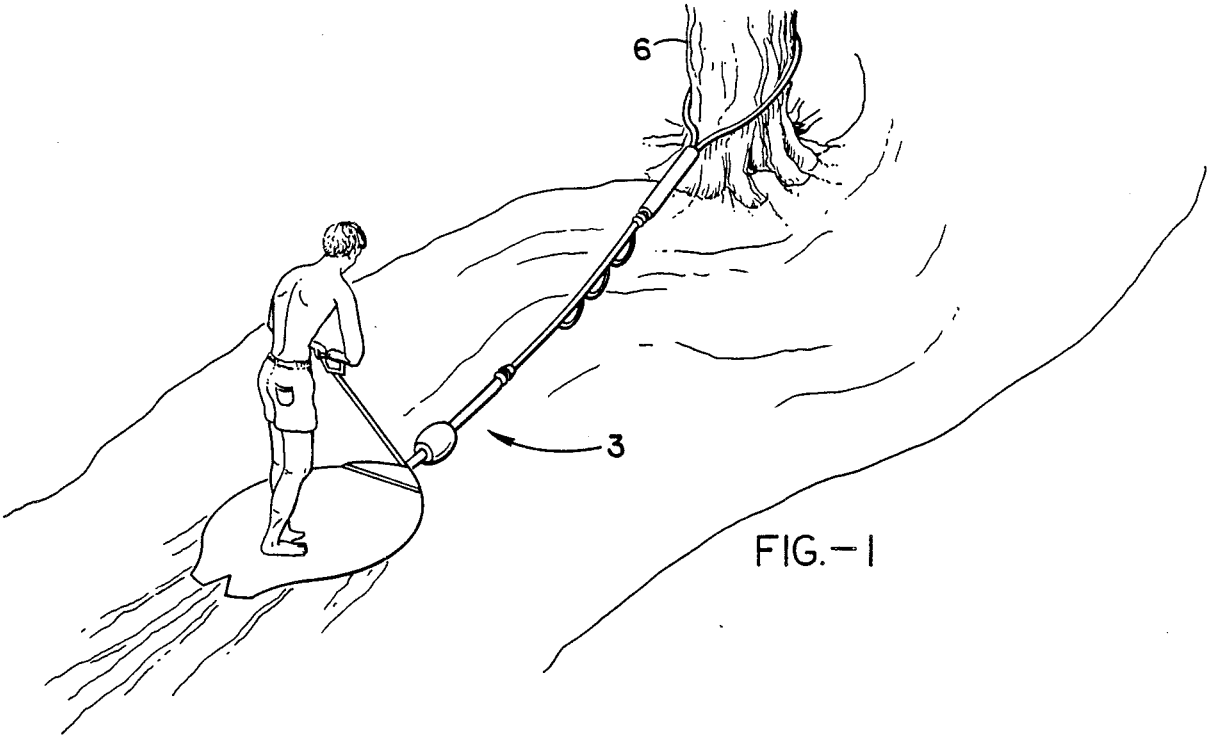
FIG. 1 is a perspective view of the subject device in use in a typical river setting.
Figure 2:
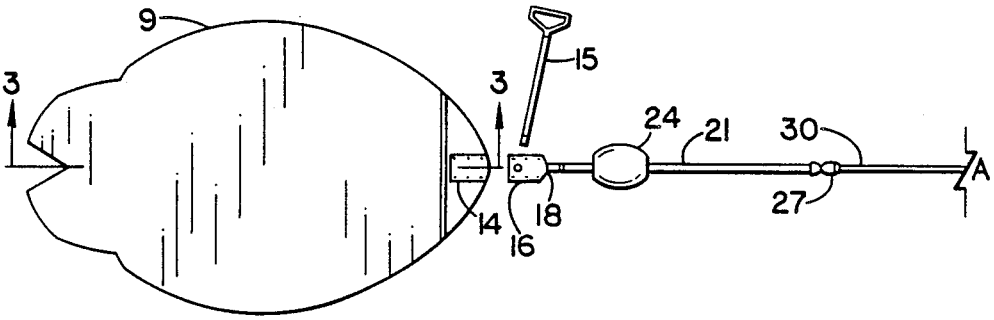
FIG. 2 is a top view of the subject invention.
Figure 2:
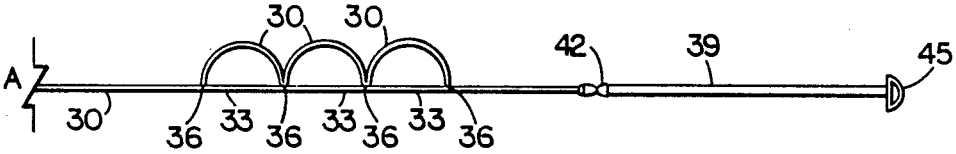
Figure 3:
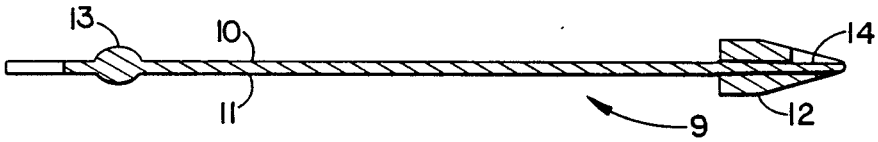
FIG. 3 is a side/cross-sectional view of the riverboard element of the subject device.

Flowing waters, usually a stream or river, although other alternatives such as human produced water currents, riding against an incoming ocean tide, being pulled by a power boat, and similar means are contemplated to be within the realm of this disclosure, have energy that may be tapped for use by a rider of the subject device. Referring now to FIGS. 1-3, there is shown a preferred embodiment of a water sport device for riding and maneuvering on the surface of flowing water. Further, incorporated in the subject invention is a safety anchoring system and associated flexible safety rod for securing a water skimming device or riverboard to an object and for protecting the rider from entanglement with the line or tether employed to secure the device.

In particular, FIG. 1 illustrates a typical method of use for the subject invention. A rider secures the device 3 to an object, either stationary or possibly a moving boat, that serves as an anchor 6. The anchor 6 is depicted as a sufficiently large tree, but other suitable objects are pilings, bridges, stakes driven securely into the shore, vehicle bumpers, boats, and the like. Further, the anchor 6 may be on the shore of a river or stream, above a river or stream (such as a bridge overhanging support, or the like), or in the water (such as a sunken piling, stake, boat or similarly functioning object).

As seen in FIGS. 2 and 3, the subject invention comprises a water skimming device, in particular a riverboard 9, usually smaller than, but similar to a surfboard of the type employed for riding the front of a wave. Even though the preferred form of the water skimming device or riverboard 9 resembles a small surfboard, other ridable objects like skis, platforms or objects with or without seats, and the like are considered to be within this disclosure and when the subject invention is described in relation to a riverboard, the description is applicable to a generalized water skimming device. Ordinarily, the exact length and edge outline of the riverboard 9 are not critical, as long as standard hydrodynamic design principles are considered. FIG. 3 shows an exemplary cross-section of the riverboard 9 illustrated in FIG. 2. The riverboard 9 may be constructed with identical upper 10 and lower 11 surfaces or with differing surfaces. Preferably the upper surface 10 and the lower surface 11 substantially mirror one another so that a user may ride on either side and are normally equipped with non-slip surfaces, foot straps, or the like.

The riverboard 9 is fabricated from materials well known in the art such as a buoyant core made from a polymeric plastic like Styrofoam or the like and a coating of fiberglass or equivalent materials. Further, wood materials such as a suitable plywood or laminate is acceptable for constructing the riverboard 9. For compact storage and transportation the riverboard 9 may be produced in a collapsible form and include appropriate locking hinges or inflatable chambers.

As FIG. 3 indicates, the front portion or region of the riverboard 9 is mated with a forward tip member 12. The forward tip member 12 is normally produced by securing to the riverboard 9 two elements, one on the upper surface 10 and one on the lower surface 11 of the riverboard 9. These two element halves of the forward tip member 12 are secured, preferably, but not critically, by reversible means, such as bolts, screws, and similar devices. The elements of the forward tip member 12 are fabricated from buoyant, rigid materials such as polymers, woods, and like substances or combinations of these substances. This forward tip member 12 serves a multiple role of providing added buoyancy to the riverboard 9, furnishing additional structural integrity for the point from which the riverboard 9 is secured, and hydrodynamically urging the riverboard 9 to skim the water surface.

An optional feature of the riverboard 9 is an aft thickening 13 proximate the tail of the riverboard 9. This aft thickening 13 encourages the aft portion of the board 9 to dive, thereby allowing the rider to achieve a more desirable riding position on the riverboard 9.

To serve as a rigid connection point on a riverboard 9 for a link between the riverboard 9 and an anchoring object, a board anchor 14 is fitted proximate the forward tip member 12 of the riverboard 9 (see FIGS. 2 and 3). The board anchor 14 comprises a generally flattened plate of metal, plastic, or equivalent material securely fastened to the riverboard 9 within or surrounded by the forward tip member 12. The board anchor 14 may be an integral, non removable part of the riverboard 9 or secured by fixed fastening means such as water resistant glues, rivets, and the like or combinations thereof, but preferably a reversible fastening means such as bolts, screws, and equivalent devices are intended and may be the same ones employed to secure the forward tip member 12 to the riverboard 9. Included in the board anchor 14 is a coupling means for mating rigidly with the next element of the invention, a board attachement means 16. Preferably, although equivalent methods are contemplated, the coupling means is a male portion of a seat belt like latch and may project beyond the tip of the riverboard 9 or be flush with the tip.

As illustrated in FIG. 2, a flexible handle 15 is attached near the board anchor 14 or may be secured directly or indirectly to the board attachment means 16. Attachment is by well known techniques such as, but not limited to, threads, welds, lock and key-like fittings, and the equivalent.

The board attachment means 16 comprises, in the preferred embodiment, a female portion of a seat belt like latch capable of mating with the male seat belt like buckle system on the board anchor 14. This mating (of board anchor 14 with board attachment means 16) produces a board binding system (or in the more general case, a water skimming device binding system between a water skimming device anchor 14 with a water skimming device attachment means 16) that is relatively rigid and not subject to bending during normal use of the invention. Although the seat belt like latch between the board anchor 14 and the board attachment means 16 is preferred (in either the male associated board anchor 14 version or a reversed female associated board anchor 14 version), equivalent linkages, either reversible or fixed, are acceptable substitutes.

Connected to the board attachment means 16 at a connection point 18 is a flexible safety rod 21 having preferably two ends. The flexible safety rod 21 (preferably flexible or bendable, but may be rigid) has a first end associated at connection point 18 with one mate of the seat belt like latch. This association is essentially rigid, thereby creating a pseudo-continuous structure from the riverboard 9 into the flexible safety rod 21. This pseudo-continuous structure prevents the user of the device from becoming entangled in a jackknife like action between the riverboard 9 and the flexible safety rod 21, which might occur with the presence of a freely bendable joint from the riverboard 9 to the safety rod 21.

The flexible safety rod 21 is fabricated from flexible materials with high tensile strength such as natural or synthetic rubbers and polymers. Even though the flexible safety rod 21 may be one or more solid or hollow shafts of appropriate high tensile strength substance, a suitable rod 21 comprises a length of high tensile strength nylon, or the equivalent, rope surrounded by a flexible coating of natural or synthetic polymer (polyvinyl chloride or the equivalent) piping or tubing. Further, a more compact flexible safety rod 21 is produced by employing a nylon rope, or the equivalent, as a high tensile strength central element that is surrounded by one or more gas filled chambers that produce a flexible, but collapsible outer shell.

A means for flotation is associated with the subject invention and is located proximate to the front of the riverboard 9 and the flexible safety rod 21. This flotation means functions to add buoyancy to the riverboard 9, the flexible safety rod 21, and a securing or connection tether 30, thereby preventing them from sinking. Although the flotation means depicted in FIGS. 1–3 comprises a float 24 positioned proximate the first end of the flexible safety rod 21 and the forward tip member 12, the flotation means associated with the rod 21 may be located proximate any part of the rod 21 and includes a flotation means incorporated as an external buoyant coating (such as a foam-like covering) on the rod 21 or as an integral part of the rod's 21 structure.

The flexible safety rod 21 serves to position the next element in the subject invention, the connection tether 30, at a distance from the rider of the device to prevent entaglement with the tether 30. A second end of the flexible safety rod 21 is fitted with a tether attachment means 27 for attaching the flexible safety rod 21 to the tether 30, thereby making them (21 and 30) continuous with or from one another. The tether attachment means 27 preferably comprises reversible linking elements such as an attachment eye and a quick release attachment eye. Usually, but not necessarily, the attachment eye is secured to the flexible safety rod 21 and the quick release attachment eye is fastened to the tether 30.

The securing tether 30, preferably having first and second ends, is generally a high tensile strength, no-stretch line such as a nylon rope or a cord having similar suitable properties. The length on the tether 30 is variable and depends upon the course of the stream, river, or flowing water and the location of the object that serves as an anchor 6. Fastened to the first end of the tether 30 is, preferably, a quick release attachment eye that attaches to, preferably, the attachment eye of the flexible safety rod 21. Other means of attachment between the flexible safety rod 21 and the tether 30 to make them continuous would be obvious and include a tether running from the board attachment means 16 through the flexible safety rod 21, thereby producing an attachment or apparent attachment between the first tether end and the second rod 21 end that is actually a continuous part of the tether 30. Therefore, by having the first tether end continuous with the second rod 21 end, the tether 30 may form the center of the flexible safety rod 21.

A possibility exists that excess, non-stretched tether 30 might entangle a rider of the device. Therefore, associated with the tether 30 is an optional tether compacting means 33 comprising, usually, at least one elastomeric member secured at a plurality of attachment points 36 along the tether 30. The compacting means 33 is adapted to expand when a stretching force is exerted through the tether 30 and to contract when the stretching force is removed, thereby compacting the tether 30. Preferably, the tether compacting means 33 comprises one or more stretchable cords (rubber, polymer, and like materials or metallic springs normally coated in a protective material such as a plastic, rubber, or like substance) secured at several attachment points 36 to the tether 30. Although the attachment points 36 may extend the entire length of the tether 30, more usually only a portion of the tether 30 is associated with the compacting means 33. FIG. 2 illustrates the tether compacting means 33 in a non-expanded form with the tether 30 compacted, while FIG. 1 shows the subject device being used in a river, thereby expanding the compacting means to a stretched or partially stretched form. Should the rider of the subject device intentionally elect to leave the riverboard 9 or is unintentionally displaced from the riverboard 9, the tether compacting means 33 will collect the bulk of the tether 30 to help prevent rider entanglement and the flexible safety rod will aid in distancing the rider from the non-stretched tether 30. Other equivalent tether compacting means 33 are contemplated to be within this disclosure and include, but are not limited to, canister-like or similar retractable devices that employ a spring-type retraction mechanism to coil excess tether 30.

Securing the second end of the tether 30 to the next element on the subject invention, an elongated resilient member 39 having two ends, is a resilient member attachment means 42. Preferably, but not necessarily, the resilient member attachment means 42 operates in a reversibly fashion for easily replacing a tether 30 or resilient member 39. One preferred type of reversible resilient member attachment means 42 comprises a tether or rope ascender (such a rope ascender is often employed by sailors or mountain climbers) fitted with a quick release attachment eye and secured between the second end of a tether 30 and an attachment eye fastened to the first end a resilient member 39.

The resilient member 39 is usually an elongated member comprising at least one high tensile strength elastomeric polymer element or at least one spring element. A rider is able to maneuver over the surface of moving water by balancing two opposing forces; one force downstream (created by the flowing water) and a second force upstream (generated by the stretched resilient member 39). The second end of resilient member 39 is adapted for fastening to an object that serves as an anchor 6 by coupling with an anchor attachment means 45. Preferably, the anchor attachment means 45 affixed to the resilient member 39 is an attachment eye or like device that allows the user to secure (by a suitable link such as a rope, chain, cable, or an equivalent element) the subject device to an anchor 6. The resilient member 39 is fabricated from at least one resilient element of a material such as an elastomeric polymer, like natural or artificial rubbers or plastics, or a spring, usually metallic. Each elastomeric polymer or spring element may be grouped with other similar or dissimilar elastomeric elements to interact cooperatively.

A combination of elements linking the riverboard 9 to an anchor 6, described above, produces a safety anchoring system that is applicable for use with a riverboard 9 or any water skimming device employed by a user for riding on the surface of flowing water. More specifically, the safety anchoring system comprises: a flexible safety rod 21, with an affiliated board binding system for connecting the rod 21 to a water skimming device; a flotation means associated with the forward tip member 12 and the rod 21; a tether 30, with an affiliated tether attachment means 27 for attaching the tether 30 to the rod 21; an optional tether compacting means 33, with associated points of attachment 36 on the tether 30; an elongated resilient member 39, with an affiliated resilient attachment means 42 for connecting the resilient member 39 to the tether 30; and an anchor attachment means 45 for fastening the resilient member 39 to an object that serves as an anchor 6.

A user or rider of the subject invention mounts the water skimming device secured to an object by the safety anchoring system and by shifting their weight maneuvers the water skimming device in various directions. By dipping the front portion of a riverboard 9 into the water and then tilting the riverboard's tip towards the water's surface, a large lower surface 11 area is exposed to the force of the moving water and the rider and riverboard 9 are drawn away from the anchor 6, thereby increasing the force by which the resilient member 39 will draw the riverboard over the water towards the anchor 6. Should the rider be dislodged from the water skimming device, the possibly dangerous tether 30 is kept at distance by the flexible safety rod 21 and optionally compacted by the tether compacting means 33, thereby lessening the chance of rider entanglement.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A water sport device employed by a user for riding on the surface of flowing water, comprising:

(a) a water skimming device;

(b) a flexible safety rod having first and second ends, wherein said first flexible safety rod end is connected to said water skimming device;

(c) flotation means associated with said water skimming device and said flexible safety rod;

(d) a tether having first and second ends, wherein said first tether end is continuous with said second flexible safety rod end whereby said safety rod keeps said tether at a distance from said user to aid in preventing said user's entanglement in said tether; and (e) an elongated resilient member having first and second ends, wherein said first resilient member end is connected to said second tether end and said second resilient member end is adapted for fastening to an object that serves as an anchor.

2. A water sport device according to claim 1, wherein said water skimming device is a riverboard.

3. A water sport device according to claim 1, wherein said flotation means comprises a buoyancy incorporated into the structure of said flexible safety rod.

4. A water sport device according to claim 1, wherein said connection between said water skimming device and said first flexible safety rod end is a rigid connection point provided by a water skimming device binding system comprising a water skimming device anchor mated with a water skimming device attachment means.

5. A water sport device according to claim 1, further comprising a means associated with said tether for reversibly compacting at least a portion of said tether.

6. A water sport device according to claim 5, wherein said compacting means comprises an elongated elastomeric member secured at a plurality of attachment points along said tether and adapted to expand when a stretching force is exerted through said tether and to contract when said force is removed, thereby compacting said tether.

7. A water sport device according to claim 1, wherein said resilient member is comprised of at least one elastomeric polymer element.

8. A water sport device employed by a user for riding through a current on the surface of flowing water, comprising:

(a) a riverboard;

(b) a flexible safety rod having first and second ends, wherein said first flexible safety rod end is connected to said riverboard by a board binding system;

(c) flotation means associated with said riverboard and said flexible safety rod;

(d) a tether having first and second ends, wherein said first tether end is continuous with said second flexible safety rod end whereby said safety rod keeps said tether at a distance from said user to aid in preventing said user's entanglement in said tether; and (e) an elongated resilient member comprised of at least one elastomeric polymer element and having first and second ends, wherein said first resilient member end is connected to said second tether end and said second resilient member end is adapted for fastening to an object that serves as an anchor.

9. A water sport device according to claim 8, further comprising a tether compacting means associated with said tether, wherein said compacting means comprises an elongated elastomeric member secured at a plurality of attachment points along said tether and adapted to expand when a stretching force is exerted through said tether and to contract when said force is removed, thereby compacting said tether.

10. A water sport device according to claim 8, wherein said object that serves as an anchor is a stationary object.

11. A safety anchoring system for securing to an anchor a water skimming device employed by a user for riding on the surface of flowing water, comprising:

(a) a flexible safety rod having first and second ends, wherein said first end is adapted for connecting to said water skimming device by a water skimming device binding system;

(b) flotation means associated with said flexible safety rod;

(c) a tether having first and second ends, wherein said first tether end is continuous with said second flexible safety rod end whereby said safety rod keeps said tether at a distance from said user to aid in preventing said user's entanglement in said tether, and (d) an elongated resilient member having first and second ends, wherein said first resilient member end is connected to said second tether end and said second resilient member end is adapted for fastening to an object that serves as an anchor.

12. A safety anchoring system according to claim 11, wherein said flotation means is a float secured to said flexible safety rod proximate to said first flexible safety rod end.

13. A safety anchoring system according to claim 11, further comprising a tether compacting means associated with said tether for compacting at least a portion of said tether.

14. A safety anchoring system according to claim 13, wherein said compacting means comprises an elongated elastomeric member secured at a plurality of attachment points along said tether and adapted to expand when a stretching force is exerted through said tether and to contract when said force is removed, thereby compacting said tether.

15. A safety anchoring system according to claim 11, wherein said resilient member is comprised of at least one elastomeric polymer element.

16. A safety anchoring system according to claim 11, wherein said resilient member is comprised of at least one spring element.

17. A safety anchoring system according to claim 11, wherein said object that serves as an anchor is a stationary object.

18. For use with a water skimming device employed by a user for riding on the surface of moving water, a flexible safety rod having first and second ends, wherein said first end is adapted for connecting to said water skimming device and said second end is adapted to be continuous from a securing tether whereby said safety rod keeps said tether at a distance from said user to aid in preventing said user's entanglement in said tether, wherein said rod comprises a central high tensile strength rope surrounded by a flexible buoyant coating.

19. A flexible safety rod according to claim 18 wherein said connection is rigid and provided by a water skimming device binding system comprising a water skimming device anchor mated with a water skimming device attachment means.

* * * * *